US007451562B2

(12) United States Patent
Lightner

(10) Patent No.: US 7,451,562 B2
(45) Date of Patent: Nov. 18, 2008

(54) FIRE PROOF PICTURE FRAME

(76) Inventor: Kurt Lightner, 3141 Edgewood City Rd., Ellicott City, MD (US) 21043

( * ) Notice: Subject to any disclaimer, the term of this patent is extended or adjusted under 35 U.S.C. 154(b) by 0 days.

(21) Appl. No.: 11/753,962

(22) Filed: May 25, 2007

(65) Prior Publication Data

US 2008/0034634 A1 Feb. 14, 2008

Related U.S. Application Data

(60) Provisional application No. 60/822,020, filed on Aug. 10, 2006.

(51) Int. Cl.
*A47G 1/06* (2006.01)

(52) U.S. Cl. ..... 40/718; 40/700; 40/732

(58) Field of Classification Search ..... 40/718, 40/725, 732, 700, 790, 406–410; 109/29; 119/247, 257, 256
See application file for complete search history.

(56) References Cited

U.S. PATENT DOCUMENTS 1,777,944 A * 10/1930 Trovato ..... 40/714
2,575,470 A * 11/1951 Salz ..... 40/700
3,709,169 A * 1/1973 Gauger et al. ..... 709/29
4,223,739 A * 9/1980 Waters ..... 169/52
4,353,327 A * 10/1982 Shroyer ..... 119/257
5,078,093 A * 1/1992 Flaherty ..... 119/256
5,515,628 A * 5/1996 Rankin ..... 40/700
6,415,739 B1 * 7/2002 Orendorff et al. ..... 119/248
2007/0277418 A1 * 12/2007 Magallanes et al. ..... 40/700

* cited by examiner

*Primary Examiner*—William L. Miller
(74) *Attorney, Agent, or Firm*—Michael L. Greenberg, Esq.; Greenberg & Lieberman, LLC

(57) ABSTRACT

A container for a picture frame capable of withstanding temperatures of 500-1000° F. for 15 to 20 minutes that employs the use of water as its main protectant. The present invention works on the property of the phase change of water from a liquid to a gas. During the phase change the temperature of the water will remain constant until all of the water has changed to gas. At sea level this temperature is about 212° F. of 100° C. Tests showing that most photographic paper can withstand temperatures of this magnitude. This test involved putting a picture is a watertight plastic baggie and submerging it in boiling water for 20 minutes. The photograph emerged unchanged.

1 Claim, 11 Drawing Sheets

FIRE PROOF PICTURE FRAME

This is a non-provisional application claiming priority to provisional patent application No. 60/822,020 filed on Aug. 10, 2006.

FIELD OF THE INVENTION

The present invention is a picture frame capable of withstanding temperatures of 500-1000° F. for 15 to 20 minutes.

BACKGROUND OF THE INVENTION

Traditionally families keep photographs of their loved ones, family pets, friends, places or special things from one's past. Many of these photographs are often kept in frames that are put on display in such places as a desk, wall or shelf. However, some families are unfortunately involved in house fires that many times destroy any and all possessions within that domicile including cherished photographs. Photographs of family members, friends or pets that have passed away are irreplaceable.

Water obviously is capable of fighting most types of fires associated with the burning of family photographs. Just as firefighters shoot water onto homes adjacent to burning structures to help prevent those homes from suffering the same burning fate of the neighboring structure, preexisting water as contained in the present invention also can prevent photographs and pictures inside the frame of the present invention from burning. Thus, there is a need for a frame that protects photographs or pictures from burning in a fire through the protective use of water. In addition, this need further requires that the photograph or picture not be obstructed or compromised in order to offer this protection. In other words, there is a need for a family keepsake to be seen through the picture frame while also being protected.

U.S. Pat. No. 3,709,169 issued to Gauger, Jr. et al. on Jan. 9, 1973 shows fire proof container for the purpose of housing and protecting valuables. Unlike the present invention Gauger's invention does not provide a method to display the items within it.

U.S. Pat. No. 4,223,739 issued to Waters on Sep. 23, 1980 shows a picture frame with fire extinguishing means associated therewith. Unlike the present invention Waters's invention is only fire proof on its back side and is not intended to protect the picture within but rather is intended to extinguish fires and provide heat protection for the user while in use. Additionally unlike the present invention, Waters's invention has a fire extinguisher located within. Additionally Waters's invention does not employ the use of water as a protectant against fire.

U.S. Pat. No. 5,515,628 issued to Rankin on May 14, 1996 shows a fire resistant jacket for use in a method of framing a picture. Unlike the present invention Rankin's invention does not employ the use of water as a protectant against fire.

Therefore a need has been established for a photograph frame that is capable of withstanding the heat produced by a fire and in turn protecting the photograph within it using water.

Additionally there is a need for a photograph frame that will protect against fire using water and still allow the photograph within to be viewable without distortion.

SUMMARY OF THE INVENTION

The present invention is a container for a picture frame capable of withstanding temperatures of 500-1000° F. for 15 to 20 minutes that employs the use of water as its main protectant.

The present invention works on the property of the phase change of water from a liquid to a gas. During the phase change, the temperature of the water will remain constant until all of the water has changed to gas. At sea level this temperature is about 212° F. or 100° C. Tests show that most photographic paper can withstand temperatures of this magnitude. This test involved putting a picture in a watertight plastic bag and submerging it in boiling water for 20 minutes. The photograph emerged unchanged.

The present invention has two separate containers made of glass or glass-like material. The outer container is filled with water and holds the inner thin frame. The outer container is then fitted and sealed with a cap equipped with two pressure release valves. These pressure-release valves open when the water begins to boil. The purpose of the pressure-release valves is to maintain ambient atmospheric pressure within the outer container once the water begins to boil. The pressure-release valves also limit the internal pressure inside the outer container, thus serving to prevent an explosion as the gas increases due to increased temperature.

The inner container is a simple watertight glass or glasslike picture frame, which is mounted to an outer base that keeps the picture centered within the main glass container. The base unit of the present invention includes a base plug that can be inserted after the glass picture frame is mounted in order to increase stability and also serves to seal it off from the outside environment. The base plug is equipped with a locking mechanism that secures it to the outer base of the present invention. It is estimated that the present invention will provide fifteen to twenty minutes of protection in temperatures of 500° F. to 1000° F. once the water has reached its boiling point. Once the water has boiled off, the present invention offers no fire protection. It is estimated that in most home fire situations, the fire is brought under control or extinguished within the present invention's effective time limits.

DETAILED DESCRIPTION

The present invention is a container for a picture frame capable of withstanding temperatures of 500-1000° F. for 15 to 20 minutes that employs the use of water as its main protectant.

Figure 1:
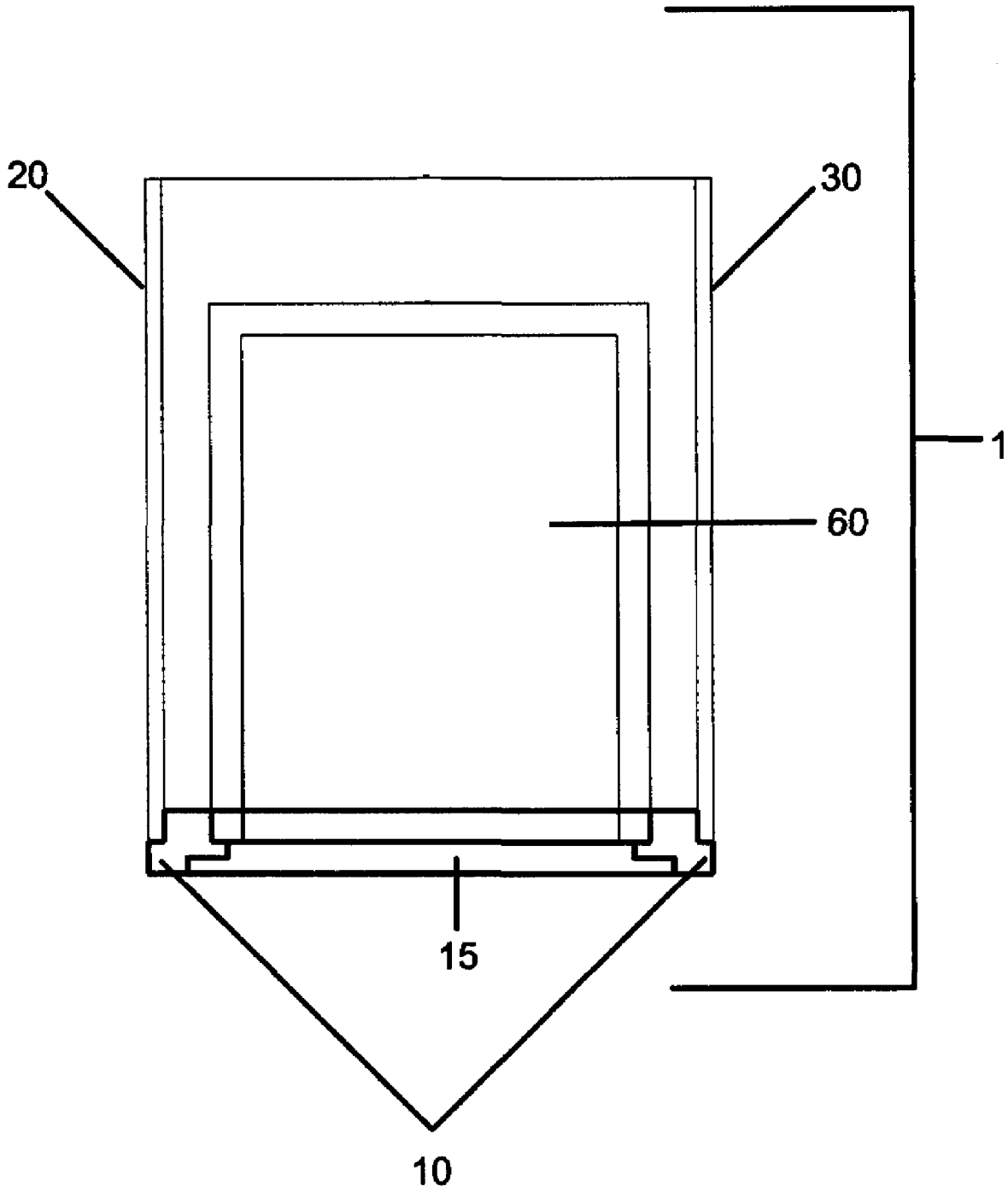
FIG. 1 is a cross-section of a front view of the main container of the present invention with a connected base plug (15).
Figure 2:
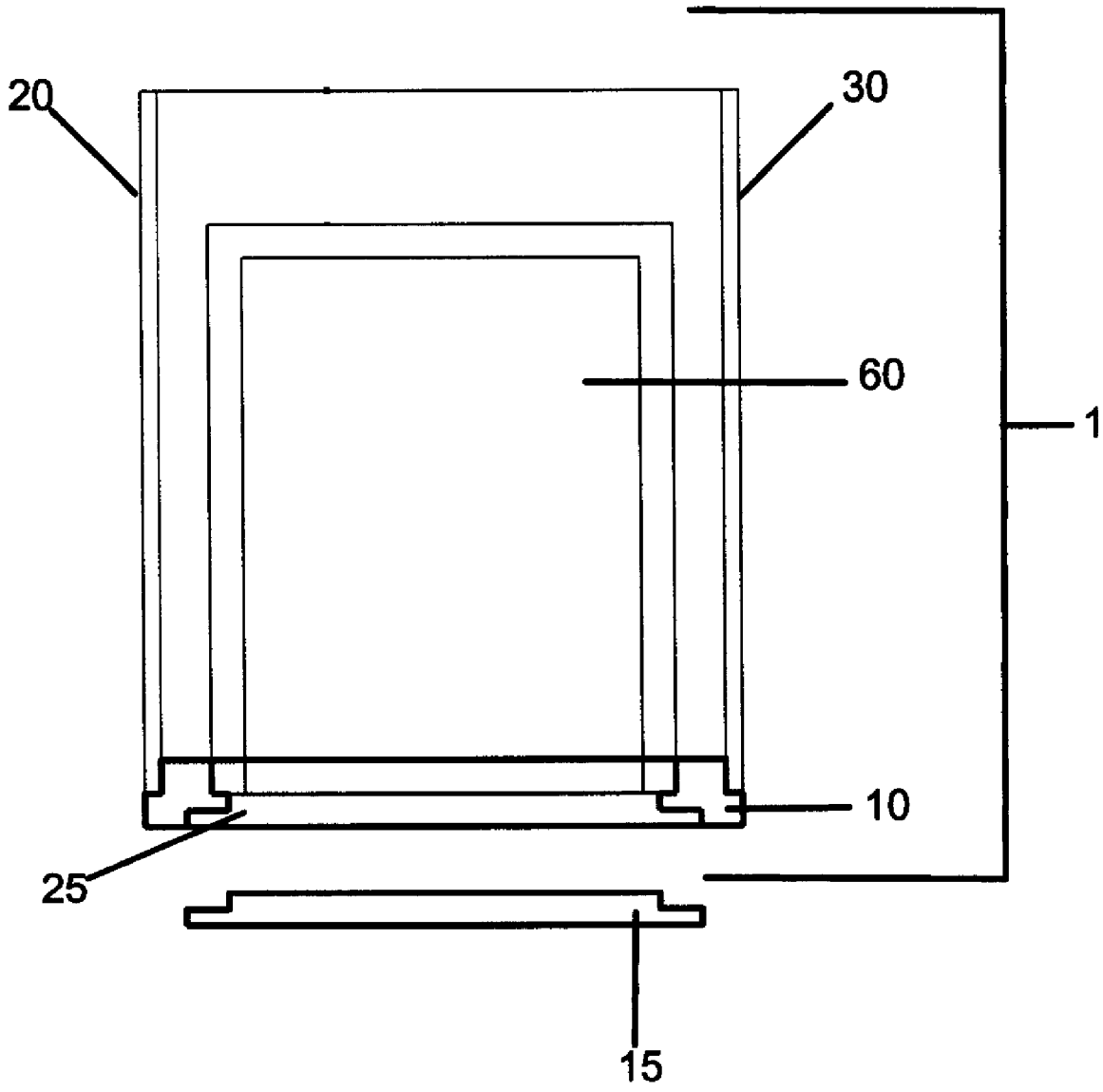
FIG. 2 is a cross-section of a main container of the present invention with a disconnected base plug (15).
Figure 3:
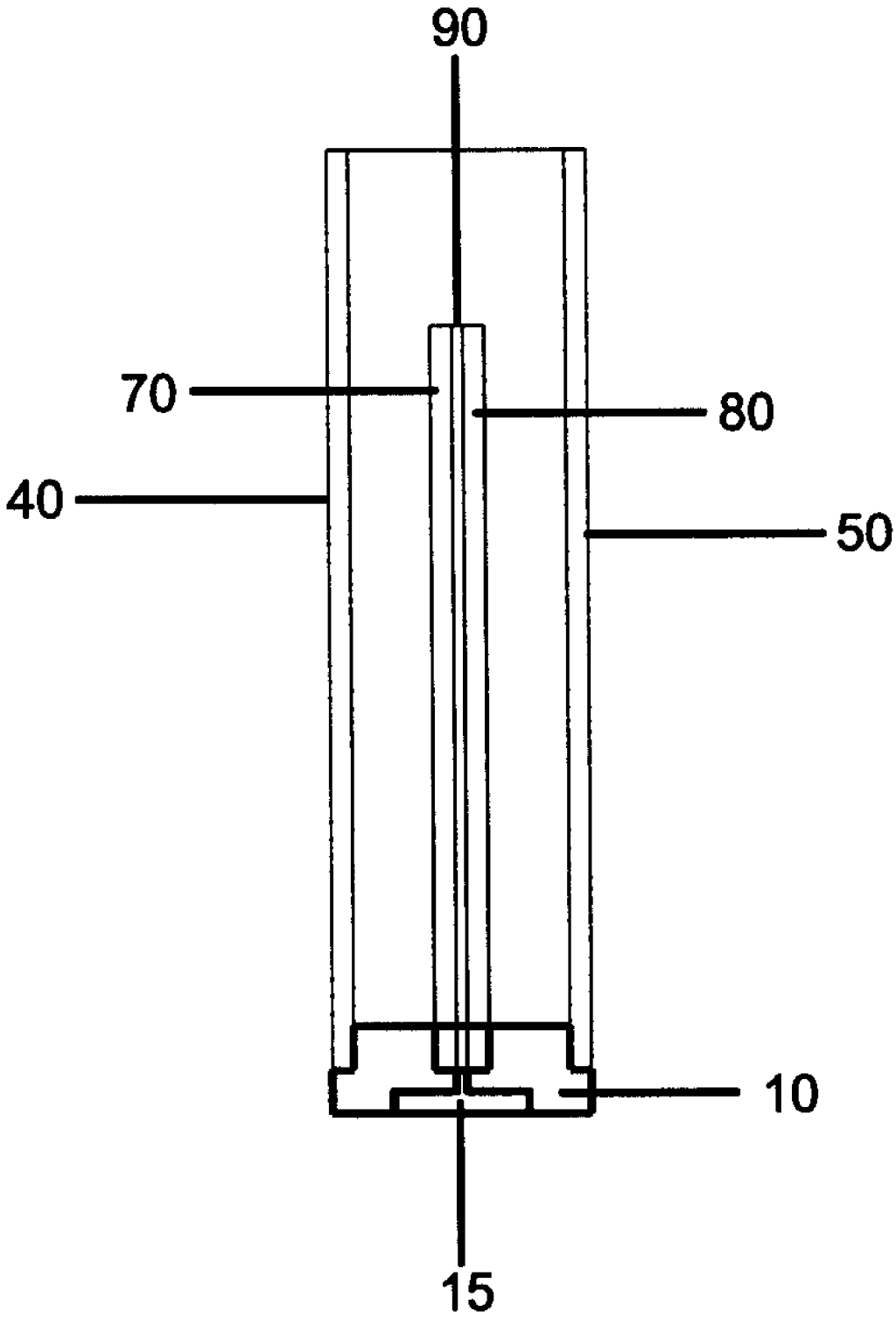
FIG. 3 is a cross-section of a side view of the main container of the present invention with a connected base plug (15)
Figure 4:
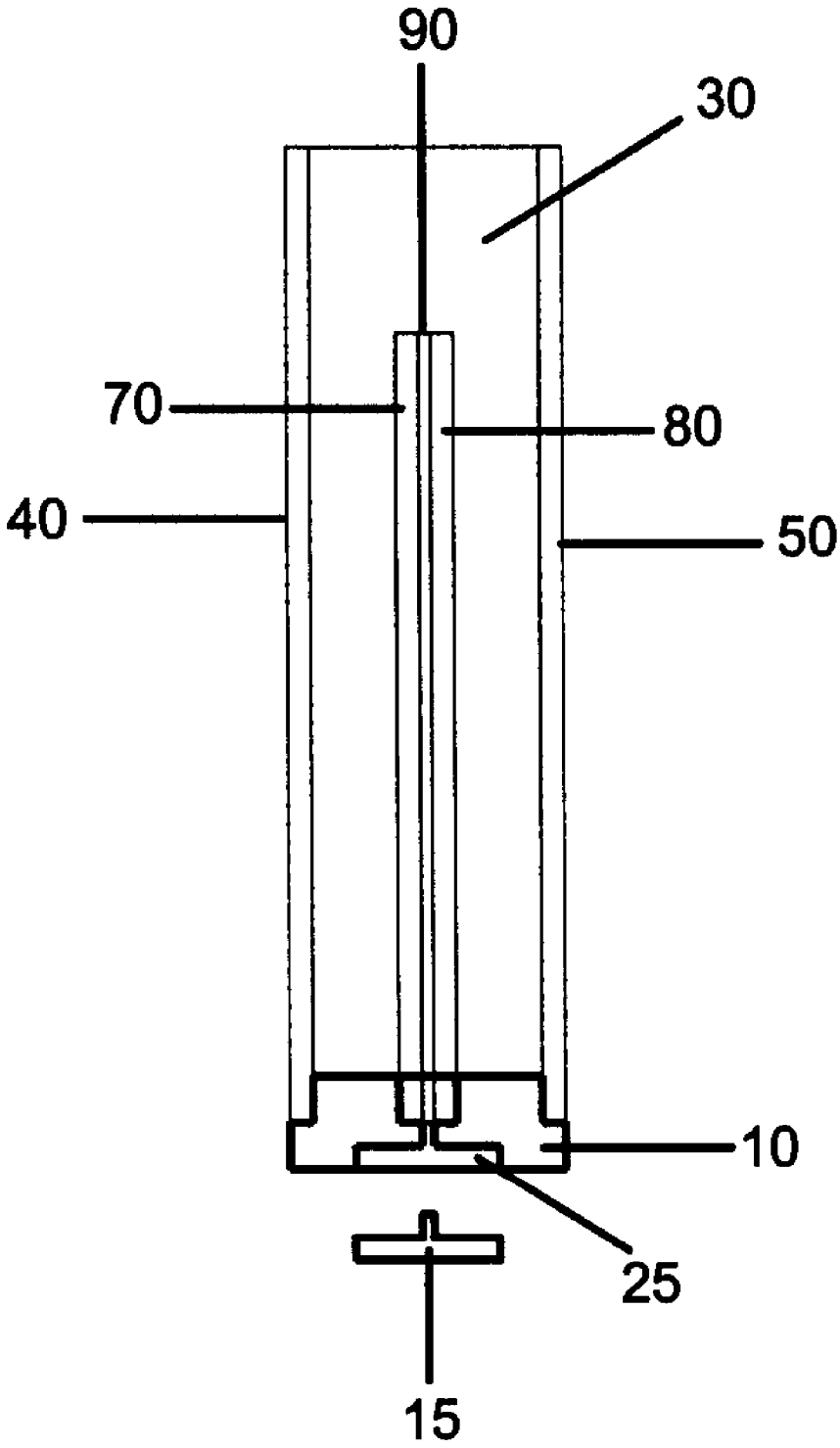
FIG. 4 is a cross-section of a side view of the main container of the present invention with a disconnected base plug (15).

FIG. 1 shows the outer container (1) of the present invention having an outer bottom section (10), first outer side (20) and second outer side (30) A front panel (40) is better shown in the side views featured in FIGS. 3 and 4 along with the back panel (50). FIG. 1 shows us the present invention with the base plug (15) connected to the overall apparatus. First and second outer sides (20 and 30) are made of glass or a glass-like manufactured material and attached to outer bottom section (10), also made of glass or glass-like manufactured material, at opposite ends at a 90° angle via any conventional waterproof adhesive means. Front panel (40) made of glass and is attached to the front faces of first and second outer sides (20 and 30) via conventional waterproof adhesive means. The outer bottom section (10) also serves as a connection point. However, the base plug (15) actually serves to hold the photograph or picture element up inside the glass or glass-like material. When the base plug (15) is connected by snug and tight placement into the outside bottom section (10) via the bottom connection space (25) as seen in FIG. 2, the inner cavity of the present invention, which places the picture or photographic element that will be contained between the glass or glass-like manufactured material between and attached to the front panel (40) and back panel (50) in conjunction with the second outer side (20 and 30) and the outer bottom section (10), is effectively sealed, making the photograph or picture element isolated from the outside environment. In addition, back panel (50) is made of glass or glasslike material and is attached to the rear faces of first and second outer sides (20 and 30) and outer bottom section (10) via conventional waterproof adhesive means.

FIG. 2 shows an additional view of the present invention that is very similar to that as seen in FIG. 1. However, FIG. 2 demonstrates how the base plug (15) can be removed as the insertion process commences in regard to the picture or photographic element that will be contained between the glass or glass-like manufactured material between and attached to the front panel (40) and back panel (50) in conjunction with the second outer side (20 and 30) and the outer bottom section (10). As seen in FIG. 2, the outer bottom section (10) has a bottom connection space (25). The bottom connection space (25) is an open area that does not fully protect or isolate the protectable contents of the present invention. As FIG. 2 further shows, the bottom connection space (25) is comparable to a cut out space that matches the base plug (15). The base plug (15) attaches snuggly and effectively into the outside bottom section (10) via the bottom connection space (25), creating the isolated, sealed environment as seen in FIG. 1.

Figure 5:
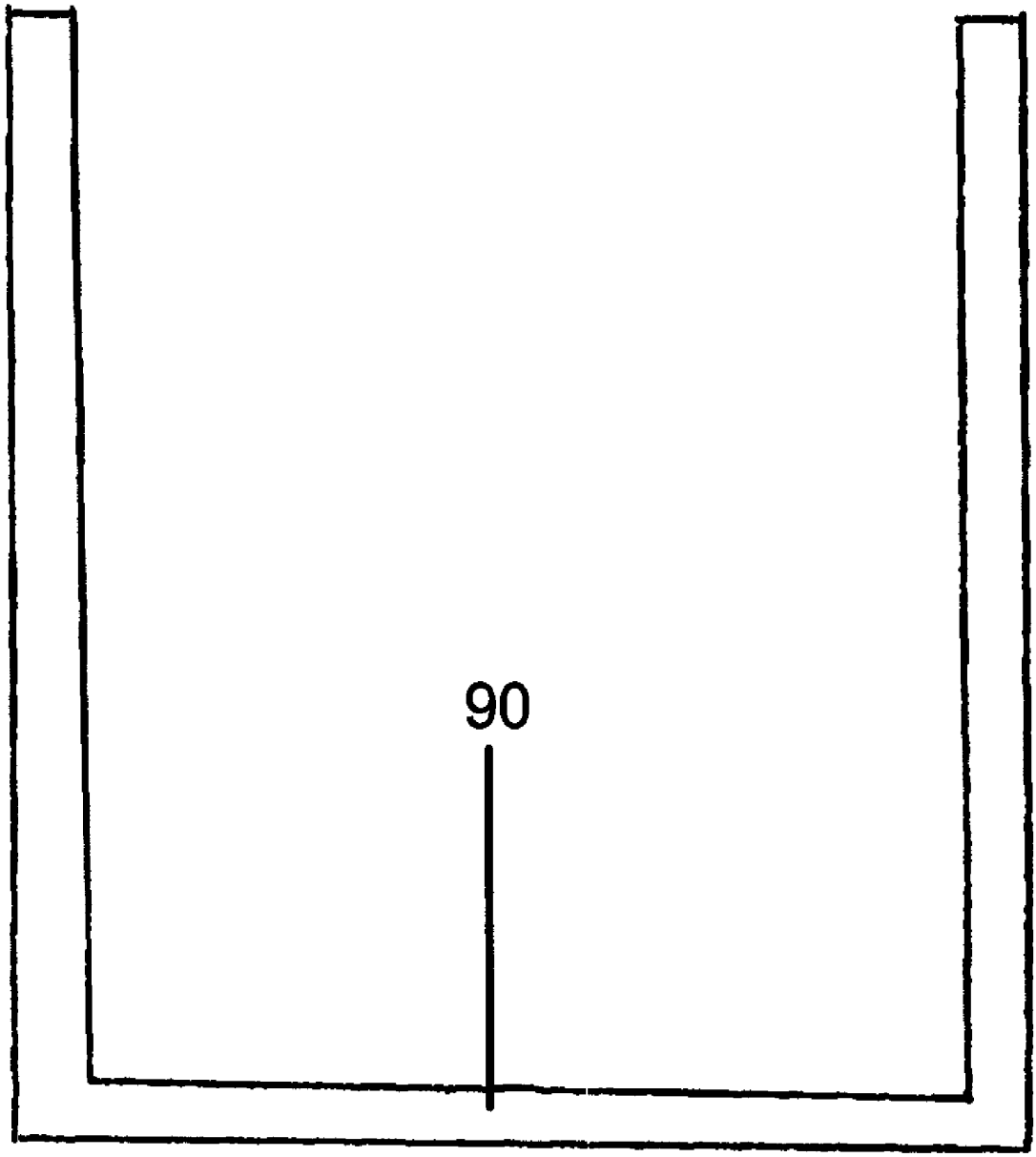
FIG. 5 is a front view of the spacer between front and rear glass plates of the internal frame of the present invention.

As shown in the side-view aspects of the present invention in FIGS. 3 and 4, the front panel (40) and the back panel (50) are connected to the outer bottom section (10) in the manner described in FIG. 1 and 2. In addition, the internal frame (60) has two panels of glass or glass-like manufactured material that can be, but is not limited to, about ¼" panels of glass, front and back. Meanwhile, the internal front panel (70) and internal back panel (80) as seen in FIGS. 3 and 4 may be separated by a ⅛" glass spacer (90). The glass spacer (90) is "U" shaped as seen in FIG. 5 to allow any desired photograph or picture to be inserted between internal front panel (70) and internal back panel (80). Internal front panel (70), glass spacer (90) and internal back panel (80) are all attached together via any conventional waterproof adhesive means. In FIG. 3, we see that the base plug (15) is connected in the same manner as described in FIGS. 1 and 2. We see in FIG. 4 a side view of FIG. 2 in that the internal cavity of the present invention is not sealed and isolated because the base plug (15) is not connected, thus leaving the bottom connection space (25) exposed.

As mentioned above, FIG. 5 shows us the glass spacer (90). The glass spacer (90) is specifically "U" shaped so that standard photographs or pictures may be inserted and ultimately protected by the present invention. However, this is merely an embodiment of the present invention as the glass spacer can conceivably be made into other shapes and dimensions.

Figure 6:
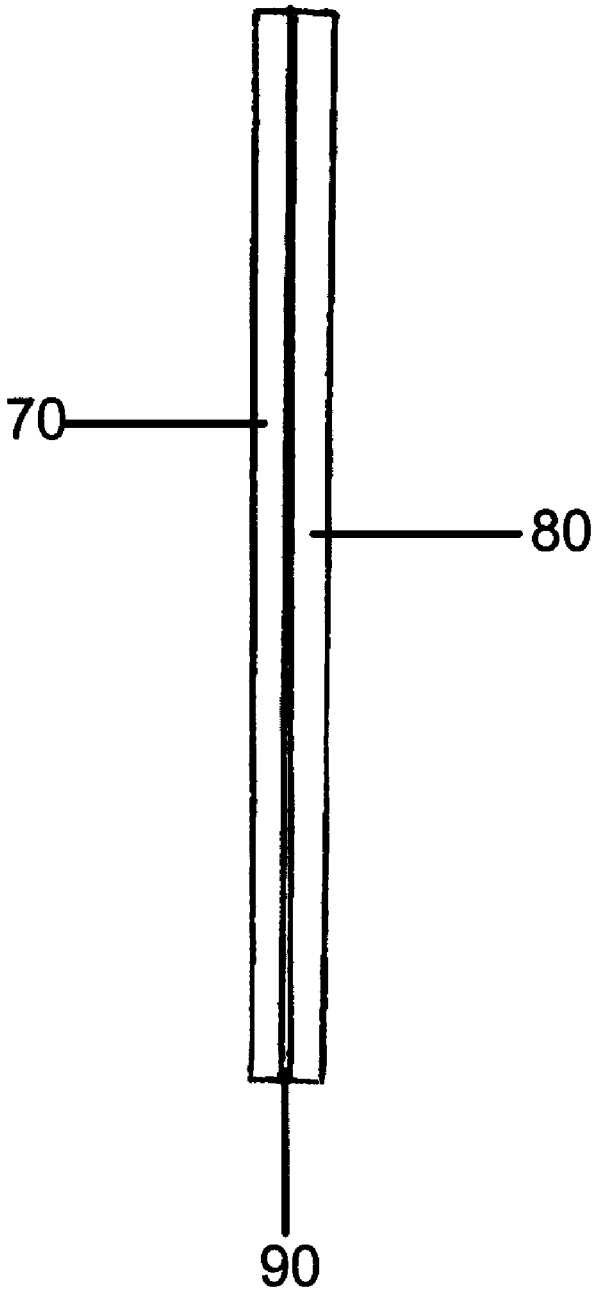
FIG. 6 is a side view of the internal frame (60) of the present invention.

As mentioned in FIGS. 3 and 4, FIG. 6 shows us an isolated side view of the internal elements of the present invention. As we see in FIG. 6, the internal front panel (70) and internal back panel (80) are separated by the glass spacer (90). An embodiment of the present invention places the glass spacer (90) at about ⅛".

Figure 7:
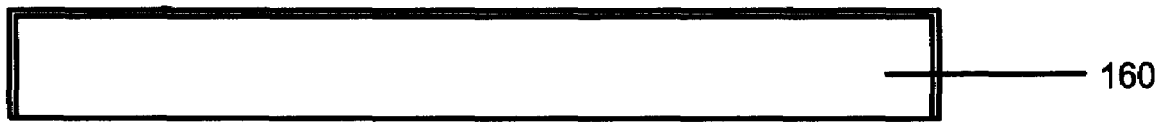
FIG. 7 is a front view of the watertight cap (160) of the present invention.
Figure 8:
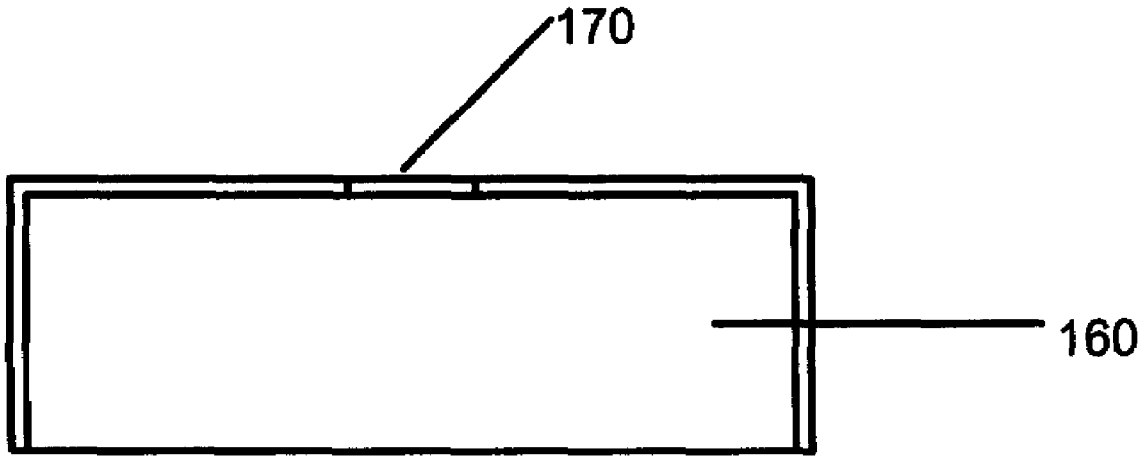
FIG. 8 is a side view of the watertight cap (160) of the present invention.

FIG. 7 shows a front view of the watertight cap (160) of the present invention. The watertight cap (160) is designed to be placed on the top of the overall present invention. The watertight cap (160) serves to create a watertight seal around the top of the outer container made up of the first and second outer side (20, 30) and the front and back panels (40, 50) once the internal frame (60) has been inserted into the outer base section (10). As mentioned, the picture or photograph itself is sealed within the internal frame (60) by the base plug (15). The watertight cap (160) is constructed of a metal consistency in the preferred embodiment, although other relatively hard materials also may suffice. In FIG. 8, we see a side view of the watertight cap (160). In FIG. 8, we also see at least one pressure release valve (170). Once the water has been placed inside the outer container (1) the watertight cap (160) with the at least one pressure release valve (170) attached is placed on top as shown in the side view of the complete assembly of the present invention in FIG. 9. The watertight cap (160) creates an air and watertight seal to prevent evaporation or leaking of the outer container (1). The use of the at least one pressure release valve (170) on the watertight cap (160) is employed so that during a fire, when the water within begins to boil and changes from a liquid to a gas, the gas has somewhere to go. The purpose of the at least one pressure release valve (170) is to maintain ambient atmospheric pressure within the outer container once the water begins to boil. The at least one pressure release valve (170) also limit the internal pressure inside the outer container, thus serving to prevent an explosion as the gas increases due to increased temperature.

Figure 9:
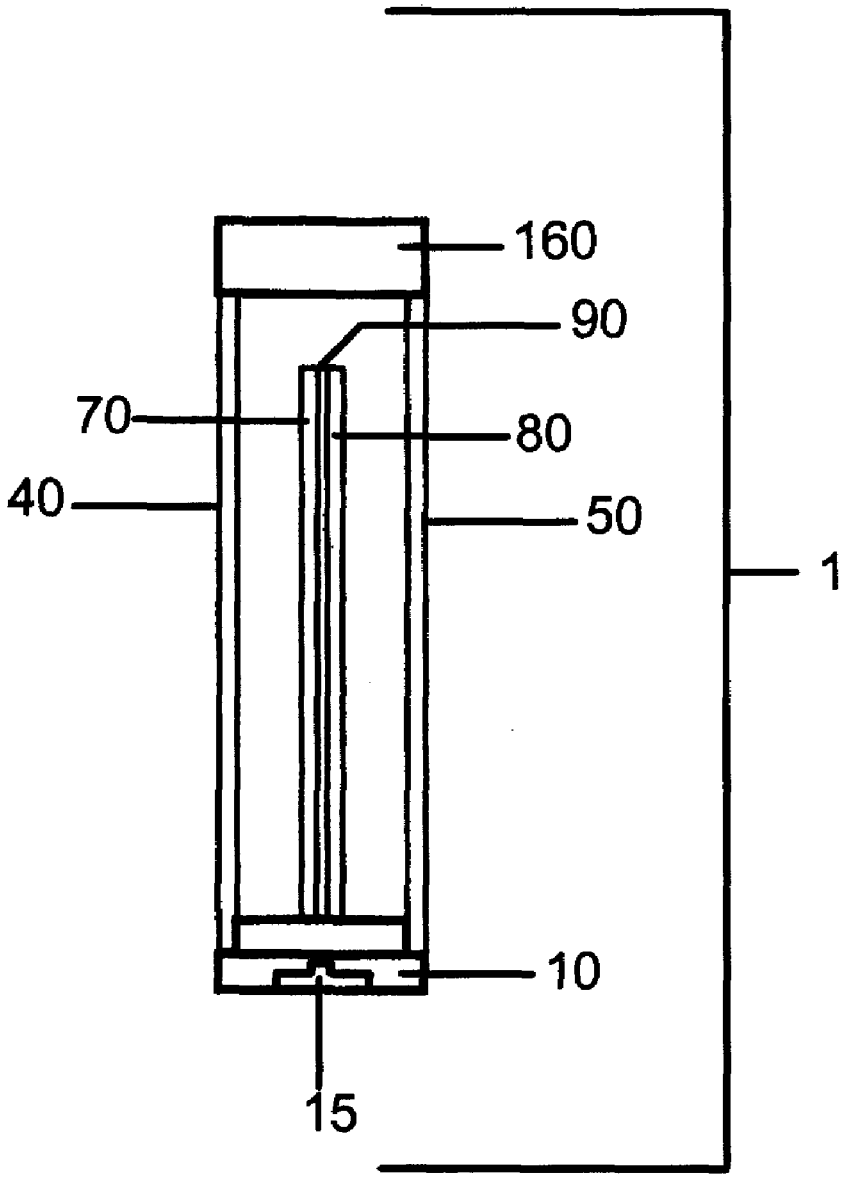
FIG. 9 is a cross-section of a side view of the complete assembly of the present invention.

As mentioned above, FIG. 9 shows us a side view of the present invention in full assembly. This includes the attached watertight cap (160) as well as the attached base plug (15). FIG. 9 shows how the watertight cap (160) operates in conjunction with the second outer side (20 and 30) and the outer bottom section (10). As we see in these figures is that once the internal frame (60) is connected to the outer bottom section (10), the whole assembly is then placed within the outer container (1). Water is then put into the outer container (1) and the base plug (15) is attached.

Figure 10:
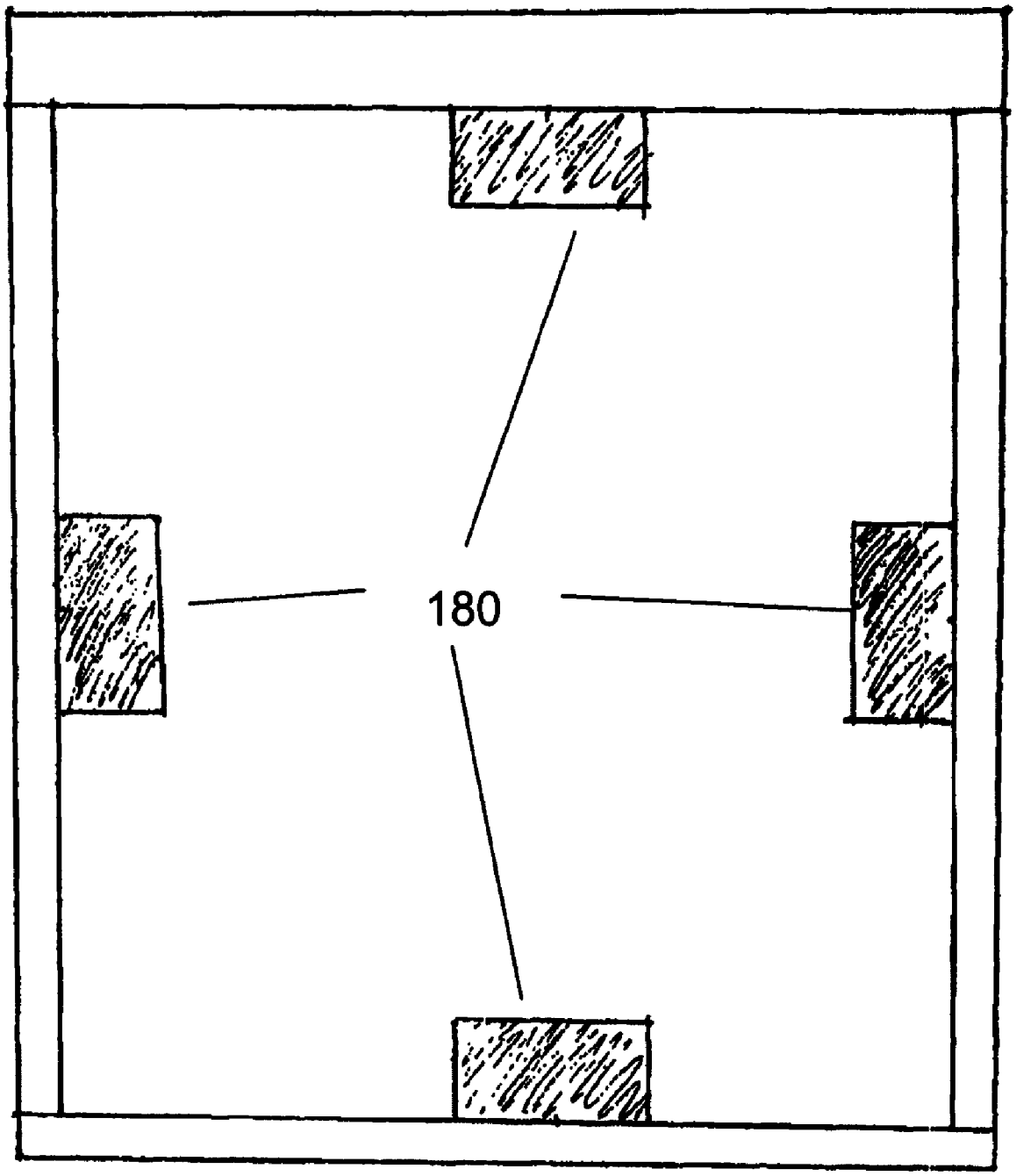
FIG. 10 is a front view of an additional embodiment of the present invention.

FIG. 10 shows that the present invention, while employing the use of hook and loop fasteners (180), is capable of attaching a conventional decorative frame to the exterior of the outer container (1). Although this is a possibility, the present invention does not offer any protection from the fire to the conventional decorative frame.

Figure 11:
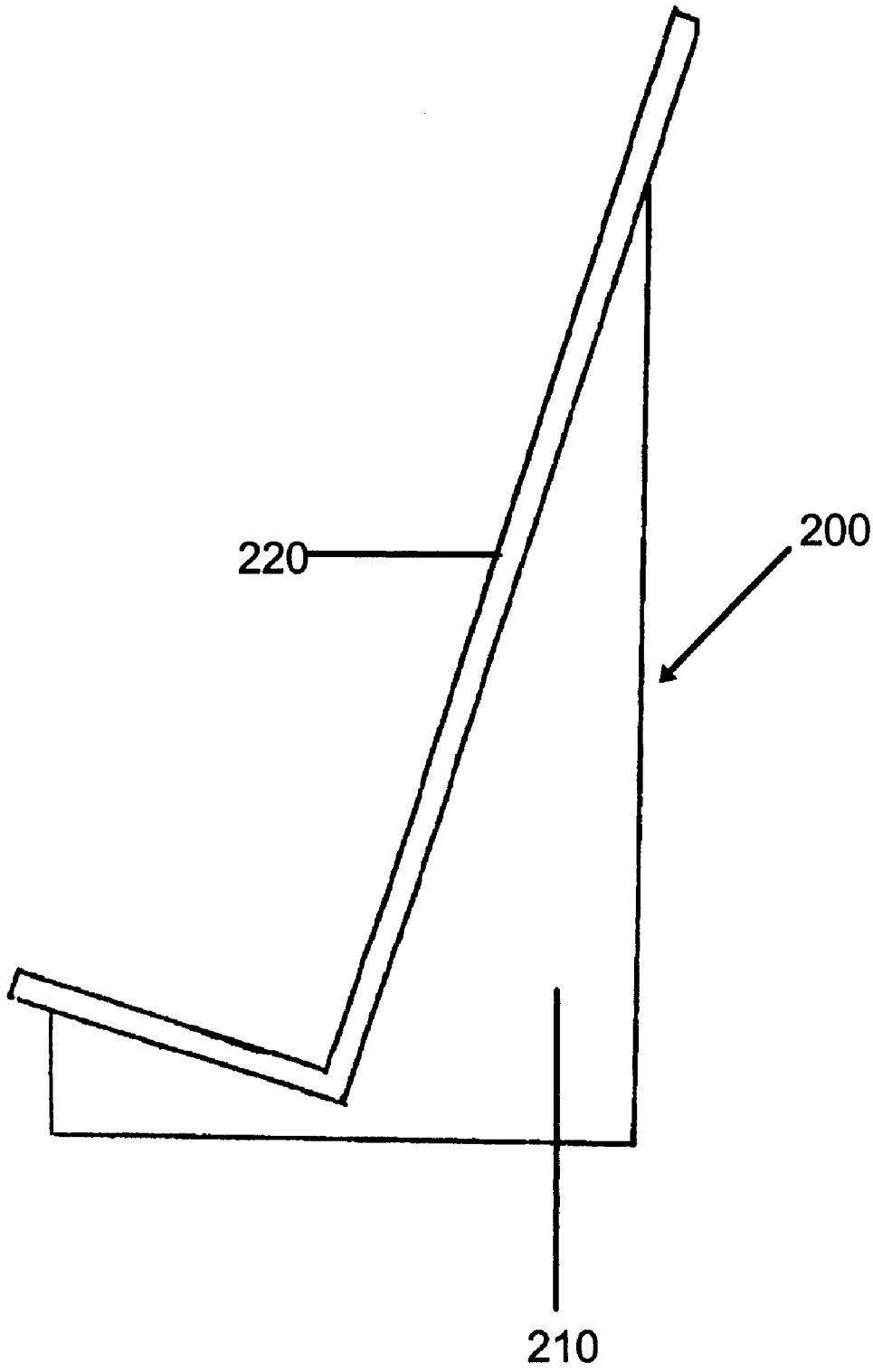
FIG. 11 is a side view of a display stand (200) serving as an additional embodiment for the present invention.

The present invention can be displayed in a variety of manners. Everything from hanging on the wall, mounting within a wall, shelf or table display. To aid in the display on a shelf, table or conceivably any horizontal surface desired, an embodiment of the present invention has a display stand as seen in FIG. 11. Display stand (200) has a main base (210) and a resting surface (220) that is formed into a 90° angle providing the capability to cradle the present invention. Additionally the display stand (200) similarly to the decorative frame is for decoration purposes only and the present invention does not provide any protection against fire.

Although the present invention can be many different sizes and dimensions it is preferred that the present invention adhere to the following guidelines and that any variation will change respectively and to scale:

Components of outer container (1)

Outer bottom section (10)—9" wide, ½" thick and 2½" deep

First and second outer side (20 and 30)—10" tall and ½" thick

Front and back panels (40 and 50)—10½" tall, 9" wide and ¼" thick

Watertight cap w/pressure release valve (160)—9" wide, 2" tall and 2½" deep

Components of internal frame (60)

Front and back panel (70 and 80)—8" tall, 7" wide and ¼" thick

U shaped spacer (90)—8" tall, 7" wide and ⅛" thick

Watertight cap (160)—7" wide, ½" tall and 2½" deep

Approximate weight at these dimensions when filled with water—10 lbs.

Having illustrated the present invention, it should be understood that various adjustments and versions might be implemented without venturing away from the essence of the present invention. The present invention is not limited to the embodiments described above, and should be interpreted as any and all embodiments within the scope of the following claims.

I claim:

1. A fire proof picture frame device for protecting a picture therein, comprising:

an outer container;

an outer base section in communication with said outer container;

an interior frame for receiving the picture and in communication with said outer base section;

wherein said interior frame is enclosed by said outer container;

wherein said outer container comprises:

at least two side pieces in communication with said outer base section;

a front piece in communication with said at least two side pieces and with said outer base section;

a back piece in communication with said at least two side pieces and with said outer base section;

a cap in commnunication with said at least two side pieces, with said front piece and with said back piece;

at least one valve in commnunication with said cap;

wherein said outer base section comprises:

a base plug;

a space within said outer base section;

wherein said base plug fits into said space within said outer base section;

wherein said interior frame comprises:

a front piece;

a spacer in communication with said front piece;

a back piece in communication with said spacer;

wherein said outer base section is within said outer container;

wherein said interior frame is attached to said outer base section within said outer container;

wherein said outer container holds water;

wherein said outer base section and said outer container are attached to one another via a waterproof adhesive;

wherein said at least two side pieces, said front piece, said back piece, said cap, and said at least one valve communicate via a waterproof adhesive;

wherein said at least one valve is a pressure release valve;

wherein said base plug connects to said outer base section; and wherein said spacer is U shaped.

* * * * *